US007223151B2

(12) United States Patent
Anderson

(10) Patent No.: US 7,223,151 B2
(45) Date of Patent: May 29, 2007

(54) RIGID BALLON

(76) Inventor: Lloyd Randall Anderson, 106 Diddle Dr., Hendersonville, TN (US) 37075

( * ) Notice: Subject to any disclaimer, the term of this patent is extended or adjusted under 35 U.S.C. 154(b) by 0 days.

(21) Appl. No.: 10/643,780

(22) Filed: Aug. 19, 2003

(65) Prior Publication Data

US 2005/0277359 A1 Dec. 15, 2005

Related U.S. Application Data

(63) Continuation-in-part of application No. 10/366,387, filed on Feb. 14, 2003, now Pat. No. 6,659,838.

(51) Int. Cl.
*A63H 3/06* (2006.01)

(52) U.S. Cl. ..... 446/220; 446/225

(58) Field of Classification Search ..... 446/220, 446/221, 222, 223, 224, 225, 226; 137/223
See application file for complete search history.

(56) References Cited

U.S. PATENT DOCUMENTS

| | | | | |
|---|---|---|---|---|
| 1,190,743 | A | 7/1916 | Fageol | |
| 1,960,474 | A | 5/1934 | Browne | |
| 2,173,963 | A | 9/1939 | Eubank | |
| 2,360,715 | A | 10/1944 | Perry | |
| 3,602,930 | A | 9/1971 | Channon | |
| 3,775,782 | A | 12/1973 | Rice et al. | |
| 3,791,611 | A | 2/1974 | Babbidge | |
| 4,032,086 | A | 6/1977 | Cooke | |
| 4,038,777 | A | 8/1977 | Schwartz | |
| 4,113,206 | A | 9/1978 | Wheeler | |
| 4,478,587 | A | 10/1984 | Mackal | |
| 4,529,153 | A | 7/1985 | Conn | |
| 4,576,375 | A | 3/1986 | Roberts | |
| 4,766,918 | A | 8/1988 | Odekirk | |
| 4,842,007 | A * | 6/1989 | Kurtz | 446/220 |
| 4,917,646 | A | 4/1990 | Kieves | |
| 4,925,426 | A | 5/1990 | Lovik | |
| 4,942,838 | A | 7/1990 | Boyer et al. | |

(Continued)

FOREIGN PATENT DOCUMENTS

| | | |
|---|---|---|
| JP | 1238890 | 9/1989 |
| WO | WO 00/10646 | 3/2000 |

OTHER PUBLICATIONS

International Search Report (EPO), dated Jun. 8, 2004.
Prior Art Helium Chamber Device sold more than one year prior to Feb. 14, 2003.
International Search Report (PCT/ISA/210), dated Aug. 8, 2005.

*Primary Examiner*—Kien Nguyen
(74) *Attorney, Agent, or Firm*—Alston & Bird LLP

(57) ABSTRACT

The rigid balloon has a chamber to hold lighter-than-air gas portions to retain a structural member or members and a separate light gas is filled into the chamber through a valve in the balloon. Structural members are inserted into the portion to help retain the desired shape of the balloon. The structural members also provide a counterbalancing weight which prevents the balloon from floating upward. Thus, the balloon, once released into the air, will retain its shape and remain floating at the height from which it was released unless repositioned.

21 Claims, 4 Drawing Sheets

U.S. PATENT DOCUMENTS 4,944,707 A 7/1990 Silverglate
4,946,047 A 8/1990 Kurokawa
4,946,067 A 8/1990 Kelsall
4,976,642 A 12/1990 Wilkie
5,024,262 A 6/1991 Huang
5,045,011 A 9/1991 Lovik
5,070,807 A 12/1991 Lewis
5,088,952 A * 2/1992 Goldblatt ..... 446/220
5,115,997 A 5/1992 Peterson
5,115,998 A 5/1992 Olive
5,141,463 A * 8/1992 Rouse, Jr. ..... 446/221
D349,593 S 8/1994 Hensley
5,334,067 A 8/1994 Henry et al.
5,334,072 A 8/1994 Epstein
5,338,243 A 8/1994 Kieves
5,385,518 A 1/1995 Turner
5,520,561 A 5/1996 Langenohl
5,571,036 A 11/1996 Hannigan
RE35,571 E 7/1997 McLeese
5,718,612 A 2/1998 Elsholz
5,803,784 A 9/1998 Plow et al.
5,810,695 A 9/1998 Sass
D400,749 S 11/1998 Bechtold, Jr.
5,882,240 A 3/1999 Larsen
5,885,123 A 3/1999 Clifford
5,893,790 A 4/1999 Montgomery
5,976,023 A 11/1999 Cho
6,015,472 A * 1/2000 Garcia ..... 156/290
6,030,300 A 2/2000 Zheng
6,073,283 A 6/2000 Zheng
6,113,453 A 9/2000 Stuffelbeam
6,170,100 B1 1/2001 Le Gette
6,192,635 B1 2/2001 Zheng
6,223,673 B1 5/2001 Mears et al.
6,276,979 B1 8/2001 Saltel et al.
6,276,984 B1 8/2001 Komaba
6,302,759 B1 * 10/2001 Hsieh ..... 446/220
6,343,391 B1 2/2002 Le Gette
6,485,344 B2 11/2002 Arias
6,592,076 B1 * 7/2003 Barnes, III ..... 244/125
6,634,040 B2 10/2003 Le Gette
6,637,146 B2 10/2003 Ernst
6,663,455 B1 * 12/2003 Lang ..... 446/71
2001/0003505 A1 6/2001 Bertrand

* cited by examiner

RIGID BALLON

CROSS-REFERENCE TO RELATED APPLICATIONS

This application claims priority from and is a continuation-in-part of U.S. Non-provisional patent application Ser. No. 10/366,387, filed Feb. 14, 2003 now U.S. Pat. No. 6,659,838, entitled RIGID HELIUM BALLOONS, the contents of which are incorporated by reference herein in their entirety.

BACKGROUND

1. Field of the Invention

The present invention relates to lighter-than-air balloons, and more particularly, to lighter-than-air balloons having a rigid skeleton.

2. Description of the Related Art

Generally, it has been difficult to fabricate balloons with continuously curved shapes, and well-defined corners, or edges. Most balloons are formed in spherical shapes in order to allow the greatest volume for the least surface area. Also, the thin material of the balloon naturally becomes spherical as pressure is increased. To achieve the desired non-spherical shape, then, it is necessary to provide a supporting frame to maintain the thin material of the balloon. However, in the past, the weight of such frames, even when the most efficient materials for such purposes were selected, typically required a displaced volume of such size that fabrication for home use or the like would have been impractical. Consequently, helium balloons are typically formed in spherical shapes with some type of tethering device attached for maintaining control of the balloon's elevation.

U.S. Pat. No. 4,032,086, issued Jun. 28, 1977 to W. Cooke, discloses an aerostat or aquastat in which a sealed envelope of flexible material is mounted on a flexible frame which can be caused to expand the envelope after it has been evacuated of internal gas, thereby setting up a vacuum or partial vacuum condition in the envelope. By controlling the frame to adjust the volume of the envelope, the lift or buoyancy of the device can be controlled in flight or precisely determined before ascent.

U.S. Pat. No. 4,038,777, issued Aug. 2, 1977 to S. Schwartz, discloses a gas filled, balloon-like object capable of defining a non-spherical shape. A high modulus graphite impregnated epoxy material is used to prevent distortion of the inflated object. Strings or weights are required to prevent upward ascent of the balloon.

U.S. Pat. No. 4,113,206, issued Sep. 12, 1978 to D. Wheeler, discloses a lighter-than-air apparatus, including a thin, pliable air-tight cuter envelope disposed in overlying relationship over a light-weight, coarse-opening inner frame of a spherelike shape.

Other devices relating to balloons and lighter-than-air apparatuses include U.S. Pat. No. 2001/0003505 A1 issued Jun. 14, 2001 to T. Bertrand, which discloses a lighting apparatus secured to a balloon by string under tension; U.S. Pat. No. 4,925,426 issued May 15, 1990 to C. Lovik, which discloses an open skeletal frame of rigid rod-like formers made of thin strands of plastic, wire, or the like and which permits the insertion of an uninflated balloon of conventional shape and size into the interior thereof so that upon inflation of the balloon, the latex sidewall material of the balloon projects outwardly through the openings of the formers to produce bulbous projections; U.S. Pat. No. 5,115,997, issued May 26, 1992 to J. Peterson, which discloses a tethered surveillance balloon having a relatively low lift-to-weight ratio; U.S. Pat. No. 5,115,998, issued May 26, 1992 to L. Olive, which discloses a double-walled, annular balloon which requires less gas to inflate than its volume would indicate; U.S. Pat. No. 5,334,072, issued Aug. 2, 1994 to M. Epstein, which discloses an inflatable body, such as a balloon, and holder assembly therefore; U.S. Pat. No. 5,882,240, issued Mar. 16, 1999 to B. Larsen, which discloses a toy blimp; U.S. Pat. No. 6,276,984, issued Aug. 21, 2001 to K. Komaba, which discloses a balloon having adhering members disposed upon its surface; Japanese Patent No. 1238890, published Sep. 25, 1989, which discloses plastic film balloons in animal and other complex shapes.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Similar reference characters denote corresponding features consistently throughout the attached drawings.

DETAILED DESCRIPTION OF THE INVENTION

Figure 1:
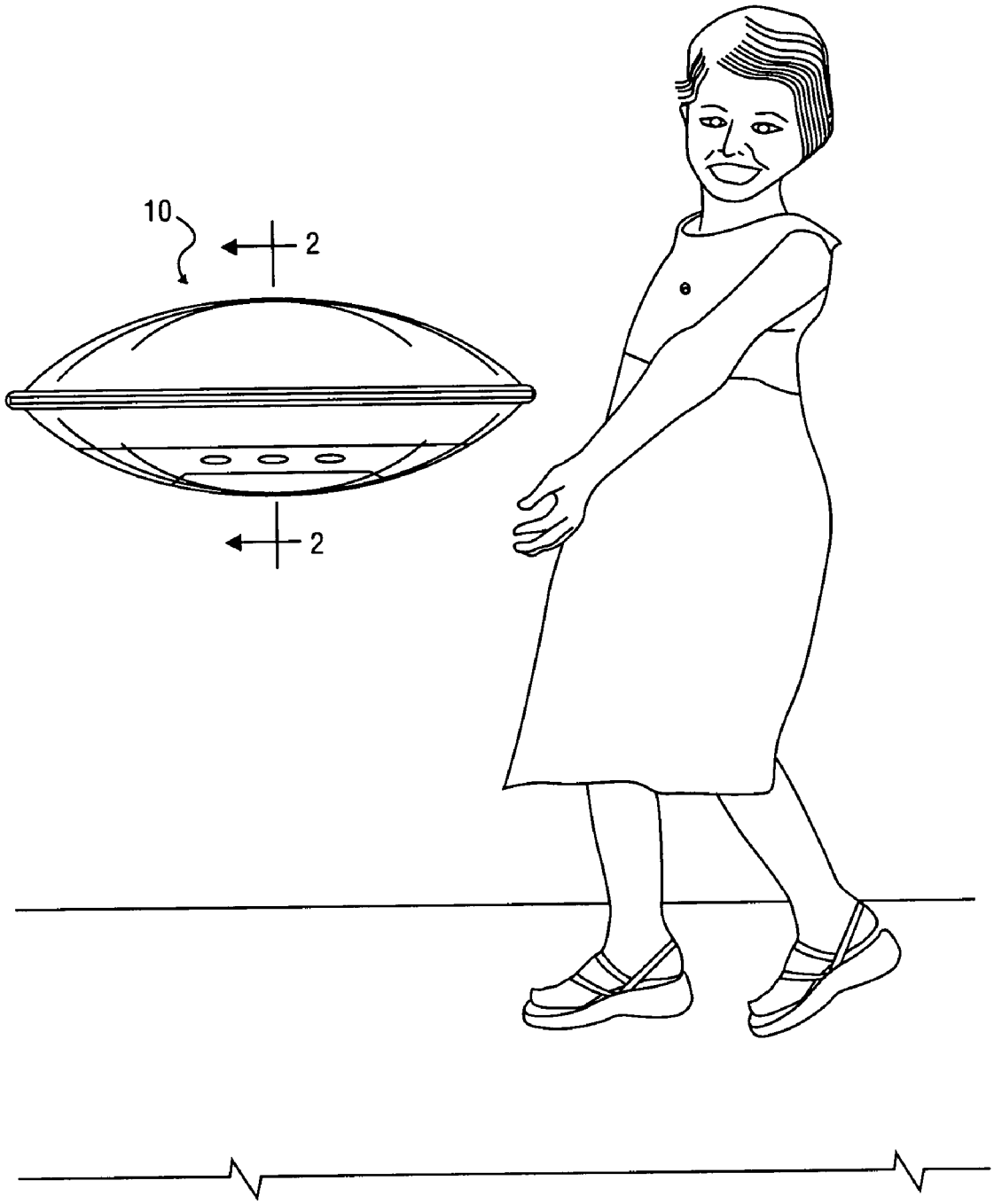
FIG. 1 is an environmental, perspective view of a rigid helium balloon according to the present inventor.
Figure 2:
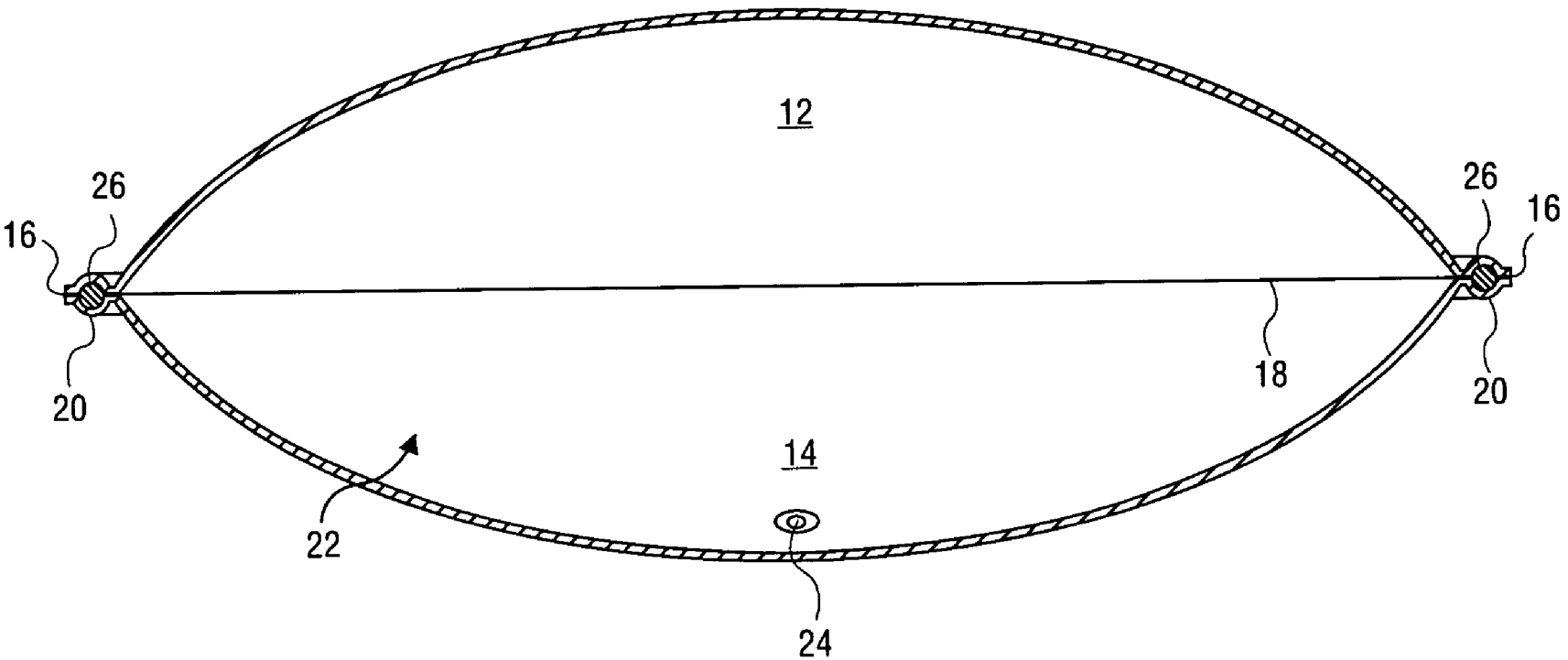
FIG. 2 is a section view along lines 2-2 of FIG. 1.

FIG. 1 is an environmental, perspective view of a rigid helium balloon according to the present inventor. As shown in FIG. 1, one embodiment of the balloon, generally designated as 10, is relatively small and can be easily adapted as a toy for indoor use. As depicted in FIG. 2, the balloon 10, is made from skin portions 12 and 14, e.g., a top half and a bottom half of the balloon 10. The skin portions 12 and 14 may be formed in any shape desired for the balloon 10. In the embodiment depicted in FIGS. 1-2, the skin portions 12 and 14 are shaped so that when the top half 12 and bottom half 14 are joined, the resulting balloon 10 is a lenticular-shaped balloon which resembles a flying saucer. Skin portions 12 and 14 can be made from any suitable heat sealable material which has low gas permeability. In one embodiment, skin portions 12 and 14 are made from polyethylene terephthalate (sold under the trademark Mylar®, a trademark of E.I. duPont de Nemours & Co. of Wilmington, Del.).

FIG. 2 is a section view along lines 2-2 of FIG. 1. As can be more clearly seen in FIG. 2 in this embodiment, the skin portions 12 and 14 are sealed together in a double seam about their periphery, including a first peripheral seam 16 and a parallel or concentric second seam 18. First seam portion 16 and second seam portions 18 are disposed near the peripheral edges of the first and second skins 12 and 14, and are spaced from one another. First seam portion 16 and second seam portion 18 are formed by heat sealing or any other suitable means. A channel portion 20 is defined between seam 16 and seam 18 and extends about the periphery of the balloon 10. Skin portions 12 and 14, when joined, define a chamber 22 therebetween which may be filled with a lighter than air gas such as helium. The chamber 22 includes a valve 24 through which the balloon 10 may be filled with the lighter than air gas. The valve 24 may be one which is commonly used in Mylar balloons, although any suitable valve may be used.

Figure 3:
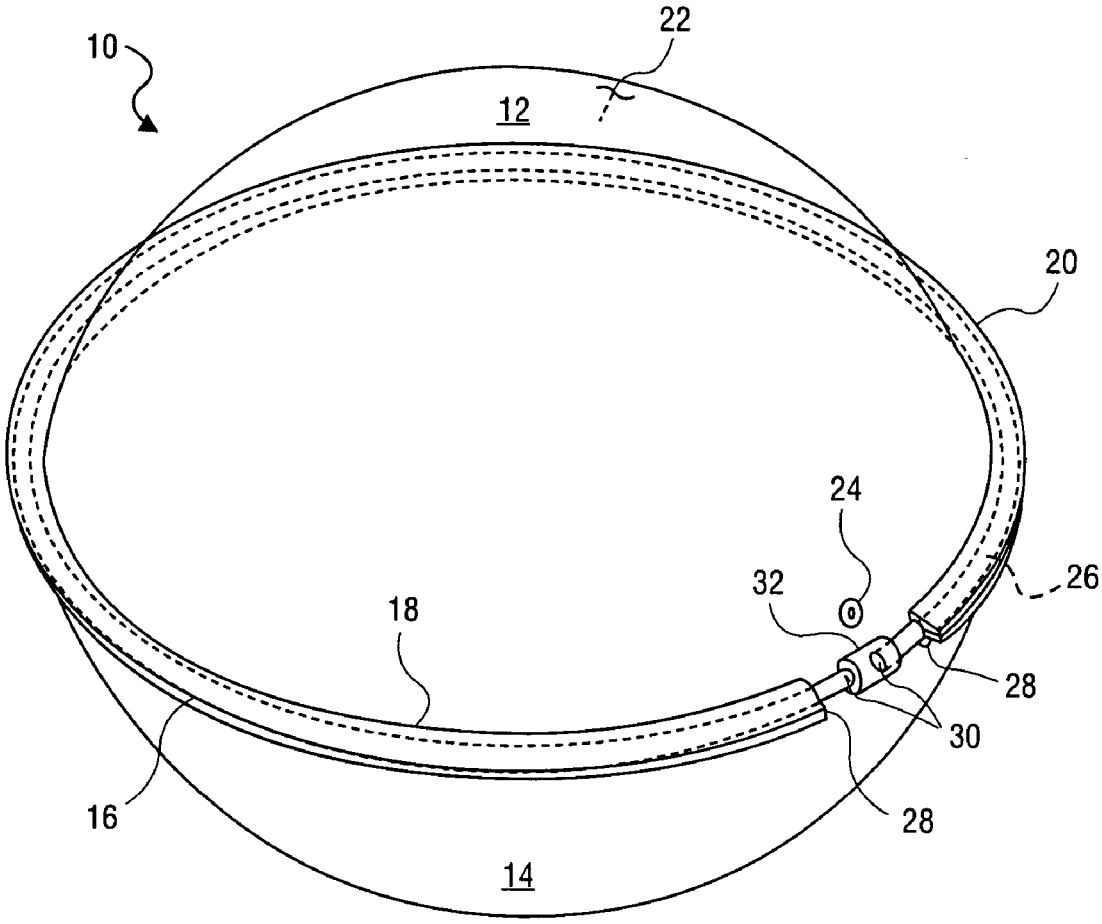
FIG. 3 is a perspective view of a rigid helium balloon according to the present invention.

FIG. 3 is a perspective view of a rigid helium balloon according to the present invention. As can be seen in FIG. 3, at least one structural member 26 is inserted into the channel portion 20 through apertures 28. While the structural member 26 can be formed from any acceptable material, in one embodiment it is made from fiberglass. In another embodiment, the structural member 26 is molded or extruded from a thermoplastic or other polymer. Once the structural member 26 has been inserted through the channel portion 20, opposing ends 30 of the structural member 26 can be joined together by a connector 32 to secure the structural member 26 in place. Any suitable connector 32 may be used to join the ends 30 of the structural member 26. In one embodiment, a brass fitting having a diameter slightly larger than the diameter of the structural member 26 is used. Alternatively, the structural member may be manufactured in a desired shape such as a ring. The ring may be placed adjacent to first seam 16 around the chamber before second seam 18 is formed. Second seam 18 may then be formed to retain the structure member 26. In such an embodiment, no connector is required.

Once the structural member 26 is secured in the channel portion 20, the structural member 26 provides a substantially rigid skeleton for the balloon 10 so that the balloon 10 may maintain its desired shape once it has been inflated with gas. The rod member 26 has a weight which is calculated to counterbalance the buoyant effect of the gas so that the balloon 10 is prevented from floating upwards when filled, the balloon 10 simply floats at the height at which it is released. Stated differently, in one embodiment, the weight of the rod (and any connector) is selected to cause the balloon to be neutrally buoyant under ambient conditions when the chamber is inflated to a known pressure with a lighter than air gas.

Although only one structural member 26 is depicted in the drawings, for some shapes, it may be necessary to use a plurality of structural members 26 of varying sizes (not shown). For such shapes, for example those with a plurality of curves or angles, a plurality of apertures may be provided at various points on the balloon 10 so that the structural members 26 may be easily inserted into the channel portion 20. The structural members 26 can then be connected to one another using the connector 32, as previously described.

Figure 4:
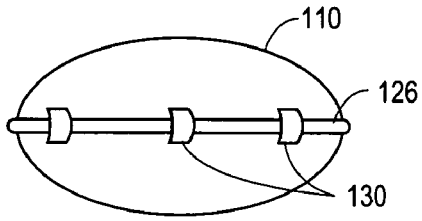
FIG. 4 is a diagram of an alternative embodiment of the rigid balloon.

FIG. 4 is a diagram of an alternative embodiment of the rigid balloon. As shown in FIG. 4, instead of creating (or in addition to) a channel for the structural member at the junction between the two skins, a plurality of strips 130 may be attached to the external surface of the flexible material covering the chamber and by either threading the structural member 126 through the loops formed by attaching the strips 130 around the structural member, the structural member 126 is retained and provides a skeleton for the balloon 110.

Figure 5:
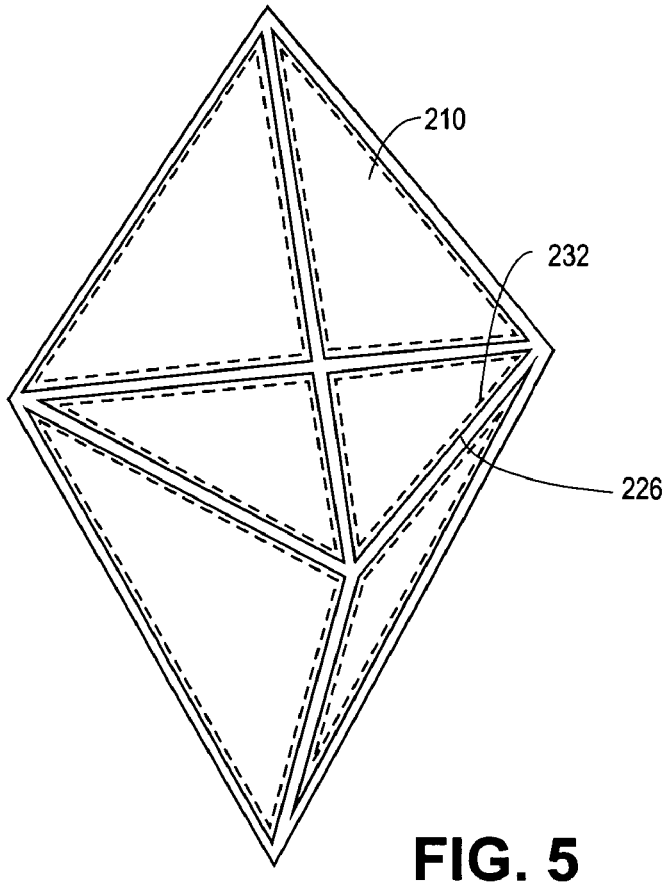
FIG. 5 is a diagram of an alternative embodiment of the rigid balloon.

FIG. 5 is a diagram of an alternative embodiment of the rigid balloon. In this embodiment, the chamber is again constructed of one or more pieces of flexible low permeability material. The flexible material may be assembled to form the chamber by heat welding; adhesive or any other manner that results in a low gas permeability ultimate chamber. In one embodiment, one or more sleeves may be coupled to the external surface of the material defining the chamber to provide receptacles for one or more structural members 226. Again, this coupling may be accomplished with adhesive, heat welding or any manner that does not substantially degrade the structural integrity of the chamber. Alternatively, pockets may be formed in a manner analogous to that described above.

Figure 6:
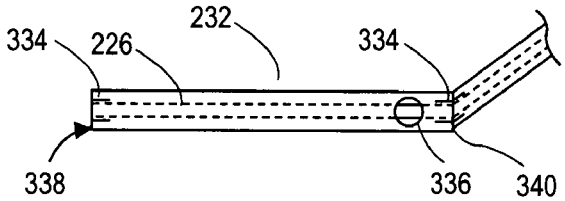
FIG. 6 is a diagram of a sleeve to retain a structural member in one embodiment of the rigid balloon.

FIG. 6 is a diagram of a sleeve to retain a structural member in one embodiment of the rigid balloon. The sleeve 232 may have one end sealed such as by heat welding. An aperture 336 is defined distal to the sealed end 338, but short of the opposing end 340. The structural member 226 having some elasticity may then be inserted into the sleeve 232 to the sealed end 338. The structural member may then be flexed so the other end of the member can be inserted past the aperture. The natural elasticity of the structural member will then hold it in place against the opposing ends of the sleeve 232.

In one embodiment, additional heat welds are used within the sleeve to provide a well-defined seat 334 for the ends of the structural member 226 to reduce movement of the structural member 226 in the sleeve 232. In one embodiment, the sleeve is open at both ends and defines a channel for the structural member. A throughway connector may be used to hold the structural member 226 together. For example, the sleeve may run circumferentially around the lenticular shaped balloon described with reference to FIGS. 1-4. In one embodiment, the sleeve may be completely sealed at the time of manufacture with the structural member enveloped within.

In one embodiment, a structural member may be a rod having substantially any shaped cross section. While rod with circular cross section is suitable for use in embodiments of the invention, square, triangular, dogbone and substantially any other cross sections are contemplated. Structural members having a thickness much less than their length or width are also contemplated.

In the foregoing specification, the invention has been described with reference to specific embodiments thereof. It will, however be evident that various modifications and changes can be made thereto without departing from the broader spirit and scope of the invention as set forth in the appended claims. The specification and drawings are, accordingly, to be regarded in an illustrative rather than a restrictive sense.

The invention claimed is:

1. An unpowered apparatus comprising:

a flexible material having low permeability to a lighter than air gas, the flexible material defining a chamber;

at least one structural member coupled to the flexible material such that when the chamber is filled with the gas to a known level, the apparatus is substantially neutrally buoyant under ambient conditions;

a valve to seal the chamber to maintain the known level during use; and a sleeve associated with the flexible material to retain the at least one structural member.

2. The apparatus of claim 1, wherein the sleeve is integral with the flexible material.

3. The apparatus of claim 1, wherein the structural member defines at least a portion of a shape of the chamber.

4. The apparatus of claim 1, wherein the sleeve is heat welded to the flexible material.

5. The apparatus of claim 1, wherein the sleeve and the flexible material are a same material.

6. An apparatus comprising:

a flexible material having low permeability to a lighter than air gas, the flexible material defining a chamber;

at least one structural member associated with the flexible material such that when the chamber is filled with the gas to a known level, the apparatus is substantially neutrally buoyant under ambient conditions; and a plurality of flexible strips heat welded to the flexible material to retain at least one structural member adjacent to the flexible material.

7. The apparatus of claim 6, wherein the structural member defines at least a portion of a shape of the chamber.

8. The apparatus of claim 6, wherein the flexible strips and the flexible material are a same material.

9. An unpowered apparatus comprising:

a flexible material having low permeability to a lighter than air gas, the flexible material defining a chamber;

at least one structural member associated with the flexible material, said structural member having a defined weight such that when the chamber is filled with the gas to a known level, the weight of said structural member counteracts a lift caused by said gas, such that said apparatus is substantially neutrally buoyant under ambient conditions; and a sleeve associated with the flexible material to retain the at least one structural member.

10. The apparatus of claim 9, wherein the sleeve is integral with the flexible material.

11. An apparatus comprising:

a flexible material having low permeability to a lighter than air gas, the flexible material defining a chamber;

at least one structural member associated with the flexible material, wherein the structural member defines at least a portion of a shape of the chamber, said structural member having a defined weight such that when the chamber is filled with the gas to a known level, the weight of said structural member counteracts a lift caused by said gas, such that said apparatus is substantially neutrally buoyant under ambient conditions.

12. An apparatus comprising:

a flexible material having low permeability to a lighter than air gas, the flexible material defining a chamber;

at least one structural member associated with the flexible material, wherein said structural member is less flexible than said flexible material for maintaining a desired shape of the apparatus; and a sleeve associated with the flexible material to retain the at least one structural member.

13. The apparatus of claim 12, wherein the sleeve is integral with the flexible material.

14. The apparatus of claim 12, wherein the sleeve is heat welded to the flexible material.

15. The apparatus of claim 12, wherein the sleeve and the flexible material are a same material.

16. An apparatus comprising:

a flexible material having low permeability to a lighter than air gas, the flexible material defining a chamber;

at least one strip associated with the flexible material to retain at least one structural member adjacent to the flexible material; and at least one structural member having opposed ends and a body extending therebetween, wherein an end of the structural member is fed through the strip and the ends are connected to each other.

17. The apparatus of claim 16, wherein said strip is a sleeve associated with the flexible material to retain the at least one structural member.

18. An apparatus comprising:

a flexible material having low permeability to a lighter than air gas, the flexible material defining a chamber;

at least one structural member that is formed of a different material from that of the flexible material and is associated with the flexible material such that when the chamber is filled with the gas to a known level, the apparatus is substantially neutrally buoyant under ambient conditions; and a sleeve associated with the flexible material to retain the at least one structural member.

19. The apparatus of claim 18, wherein the sleeve is integral with the flexible material.

20. The apparatus of claim 18, wherein the structural member defines at least a portion of a shape of the chamber.

21. The apparatus of claim 18, wherein the sleeve is heat welded to the flexible material.

* * * * *